US008583014B2

(12) United States Patent
Ninomiya et al.

(10) Patent No.: US 8,583,014 B2
(45) Date of Patent: Nov. 12, 2013

(54) POWDER HOLDING CONTAINER WITH AN OPENING AND CLOSING MEMBER HAVING A RESILIENT TAB SURROUNDED BY A CUTOUT

(75) Inventors: Yosuke Ninomiya, Kanagawa (JP); Kazuhiro Saito, Kanagawa (JP); Satoru Hori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 387 days.

(21) Appl. No.: 13/021,072

(22) Filed: Feb. 4, 2011

(65) Prior Publication Data

US 2012/0076548 A1 Mar. 29, 2012

(30) Foreign Application Priority Data

Sep. 27, 2010 (JP) ..... 2010-215786

(51) Int. Cl.
*G03G 15/08* (2006.01)

(52) U.S. Cl.
USPC ..... 399/260; 399/262

(58) Field of Classification Search
USPC ..... 399/258, 260, 262
See application file for complete search history.

(56) References Cited

U.S. PATENT DOCUMENTS

| | | | | |
|---|---|---|---|---|
| 7,650,097 | B2 * | 1/2010 | Yoon et al. | 399/262 |
| 8,095,048 | B2 * | 1/2012 | Awano et al. | 399/260 |
| 2010/0247156 | A1 | 9/2010 | Awano | |

FOREIGN PATENT DOCUMENTS

| | | | |
|---|---|---|---|
| JP | 2005-189523 | A | 7/2005 |
| JP | 2005-331617 | | 12/2005 |
| JP | 2010-230899 | A | 10/2010 |

OTHER PUBLICATIONS

Japanese Office Action mailed Mar. 21, 2012 for corresponding Japanese patent application No. 2010-215786.

* cited by examiner

*Primary Examiner* — William J Royer
(74) *Attorney, Agent, or Firm* — Sughrue Mion, PLLC

(57) ABSTRACT

A powder holding container includes: a tubular shaped section that is formed in a tubular shape with a hole formed in a tube wall for letting powder pass through; an opening and closing member that moves in a straight line inside the tubular shaped section to open and close the hole; a projection portion that projects out from the opening and closing member and enters the hole; and a resilient tab that is formed by a cutout provided in the opening and closing member, and is resiliently deformable in directions in which the projection portion enters or exits the hole.

9 Claims, 19 Drawing Sheets

POWDER HOLDING CONTAINER WITH AN OPENING AND CLOSING MEMBER HAVING A RESILIENT TAB SURROUNDED BY A CUTOUT

CROSS-REFERENCE TO RELATED APPLICATION

This application is based on and claims priority under 35 USC 119 from Japanese Patent Application No. 2010-215786 filed on Sep. 27, 2010.

BACKGROUND

Technical Field

The present invention relates to a powder holding container and an image forming apparatus.

SUMMARY

A first aspect of the present invention is a powder holding container including: a tubular shaped section that is formed in a tubular shape with a hole formed in a tube wall for letting powder pass through; an opening and closing member that moves in a straight line inside the tubular shaped section to open and close the hole; a projection portion that projects out from the opening and closing member and enters the hole; and a resilient tab that is formed by a cutout provided in the opening and closing member, and is resiliently deformable in directions in which the projection portion enters or exits the hole.

BRIEF DESCRIPTION OF THE DRAWINGS

Exemplary embodiments of the present invention will be described in detail based on the following figures, wherein.

DETAILED DESCRIPTION

Figure 1:
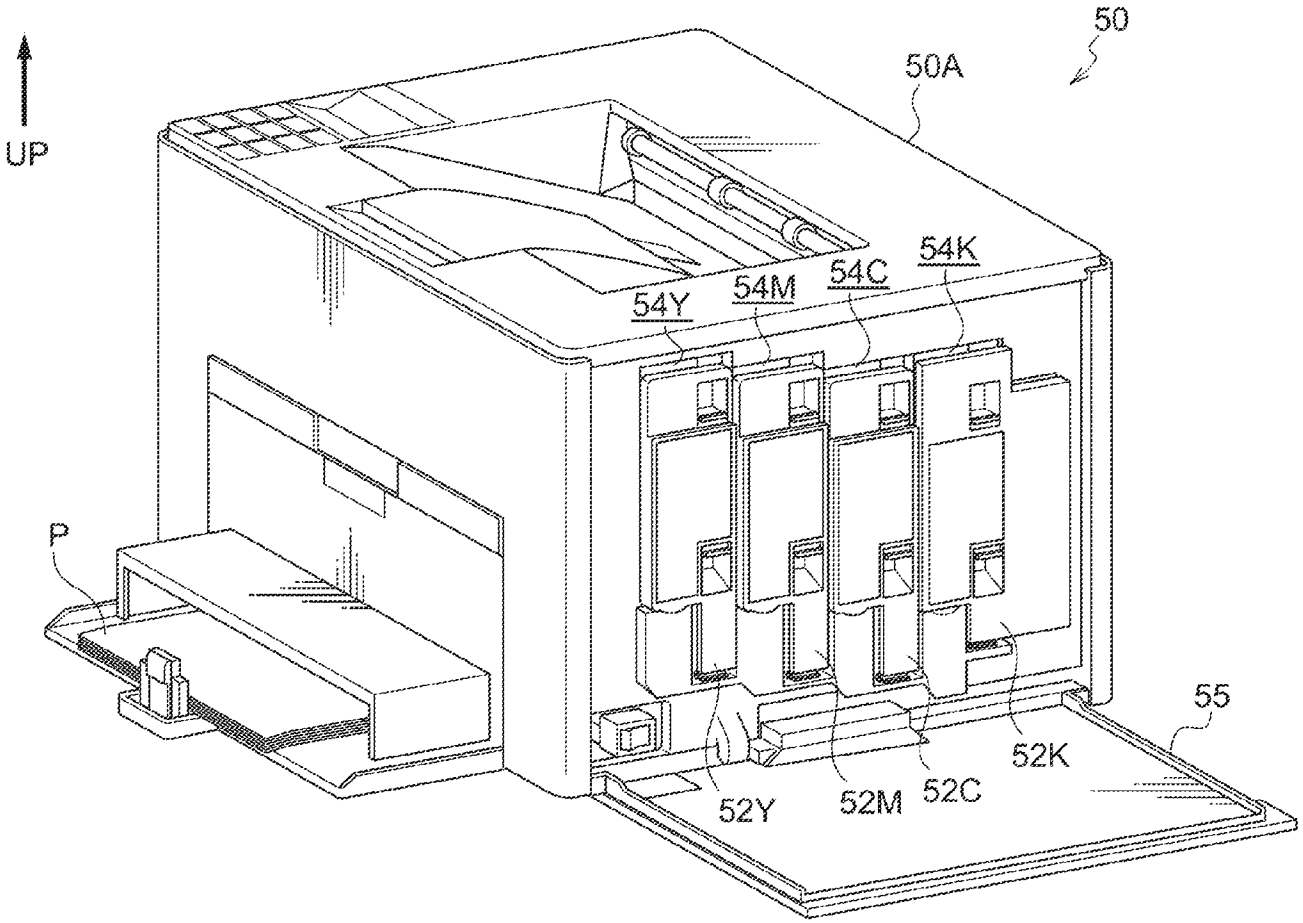
FIG. 1 is a perspective view showing a toner cartridge and image forming apparatus main body according to an exemplary embodiment of the present invention.

Explanation now follows regarding an example of a powder holding container and an image forming apparatus of the present exemplary embodiment, with reference to FIG. 1 to FIG. 19. In the drawings the arrow UP indicates the vertical direction.

Overall Configuration

Figure 2:
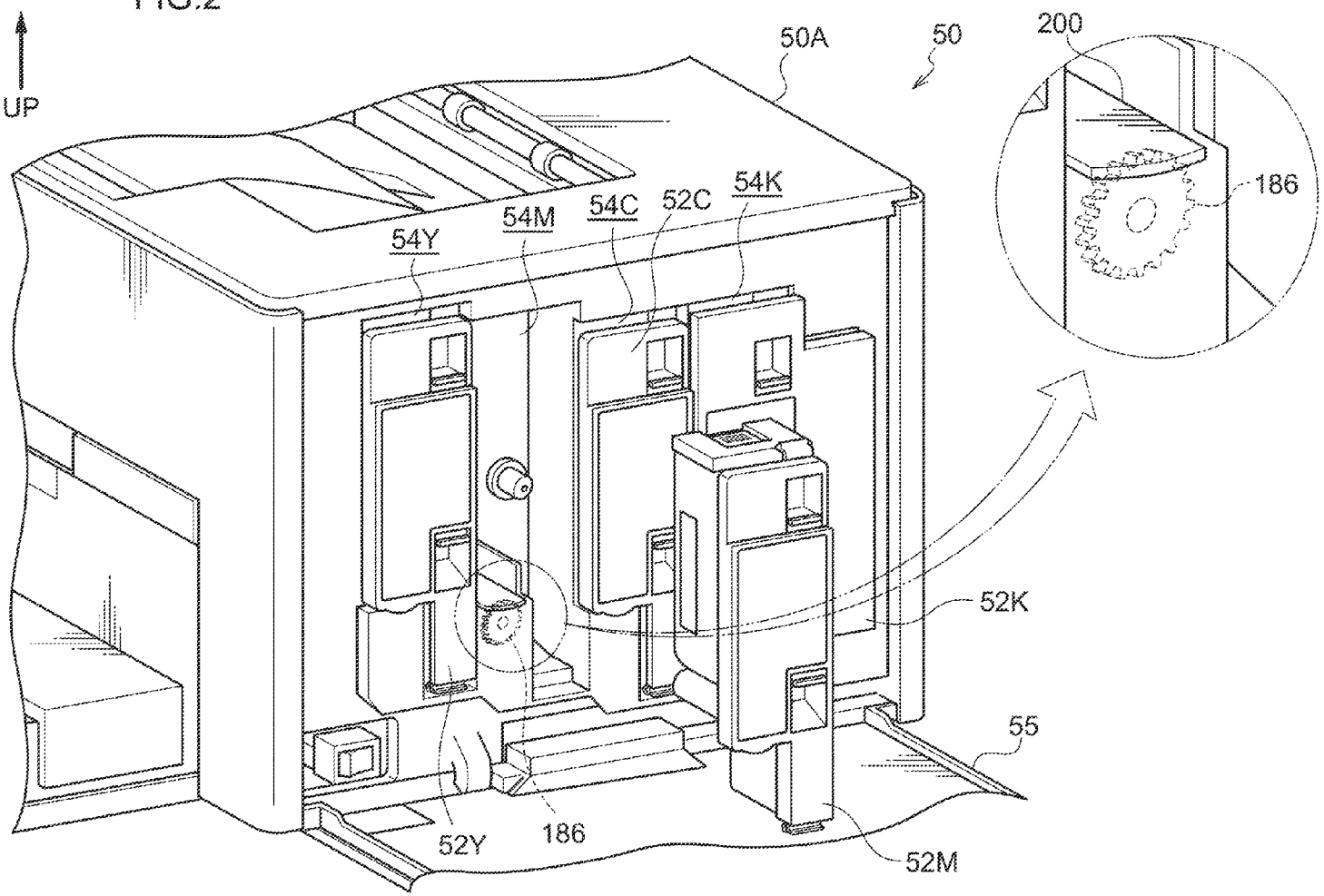
FIG. 2 is a perspective view showing a toner cartridge and image forming apparatus main body according to an exemplary embodiment of the present invention.

As shown in FIG. 1 and FIG. 2, a cover 55 is provided in a side portion of an image forming apparatus 50, so as to open the side face of the image forming apparatus 50. Provided at an inclined angle with respect to the horizontal direction inside the cover 55 are toner cartridges 52Y, 52M, 52C, 52K, serving as an example of powder holding containers for holding toners of each of the colors yellow (Y), magenta (M), cyan (C) and black (K), and toner cartridge housing sections 54Y, 54M, 54C, 54K of recessed shape for detachably housing the toner cartridges 52Y, 52M, 52C, 52K of each of the colors.

Namely, the toner cartridges 52Y, 52M, 52C, 52K are replaceably (detachably) provided to an apparatus main body 50A of the image forming apparatus 50. Note that in the following explanation, the component reference numeral suffixes Y, M, C, K corresponding to each of the respective colors yellow, magenta, cyan, black will be omitted except when it is necessary to discriminate therebetween. Details are given later regarding the toner cartridges 52.

Figure 3:
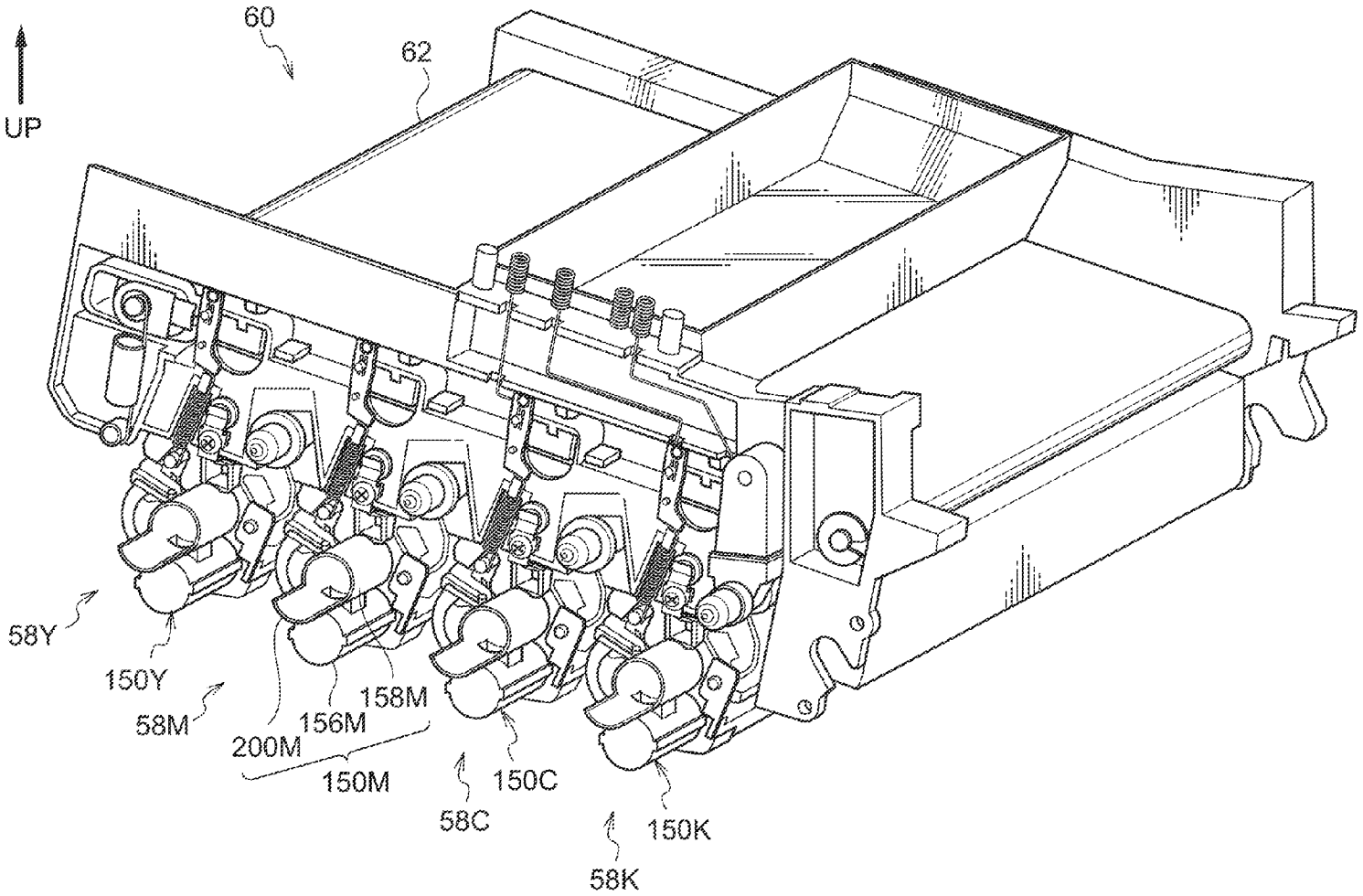
FIG. 3 is a perspective view showing a transfer section and image forming units for each of the colors employed in an image forming apparatus according to an exemplary embodiment of the present invention.
Figure 4:
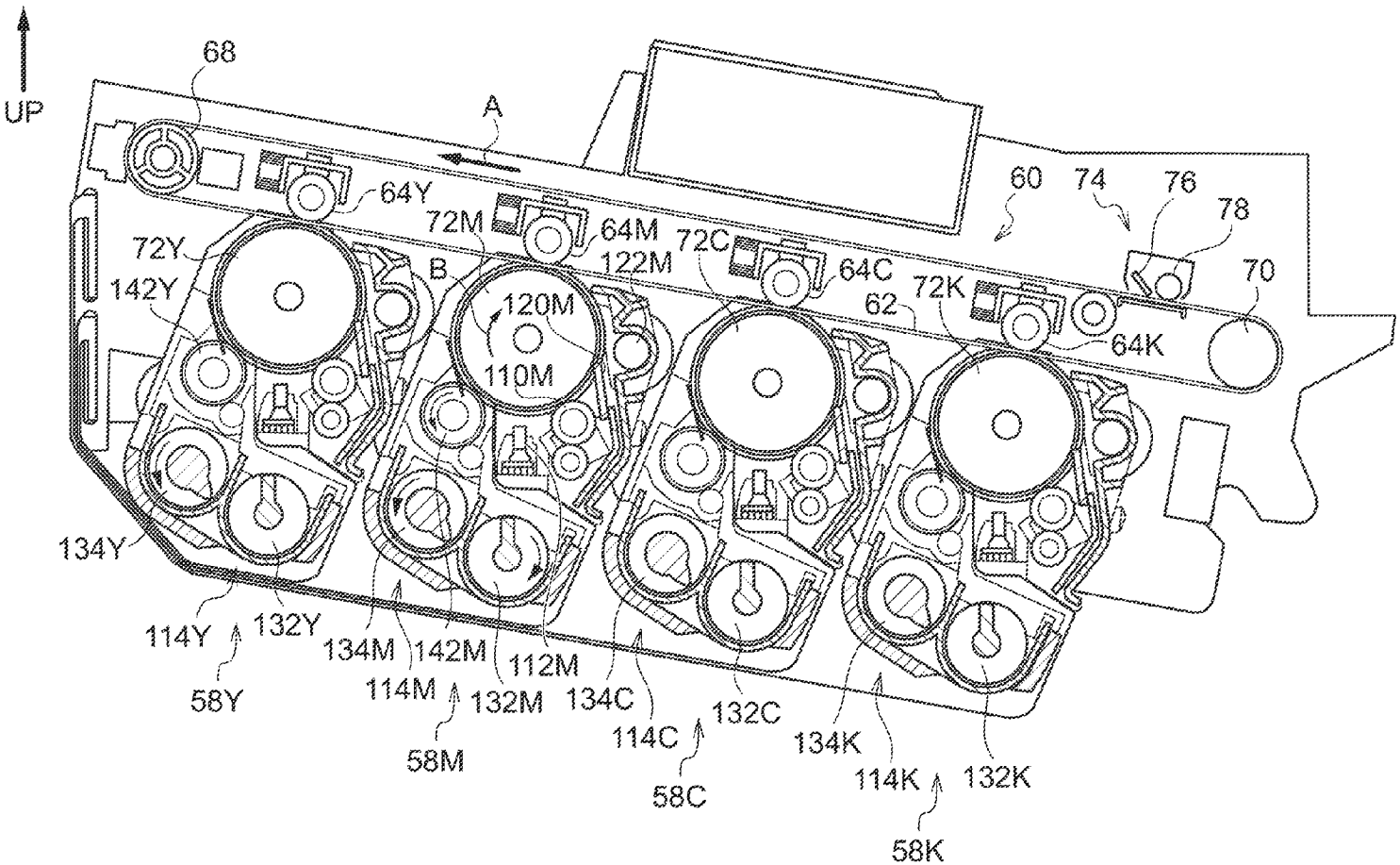
FIG. 4 is a side view showing a transfer section and image forming units for each of the colors employed in an image forming apparatus according to an exemplary embodiment of the present invention.
Figure 5:
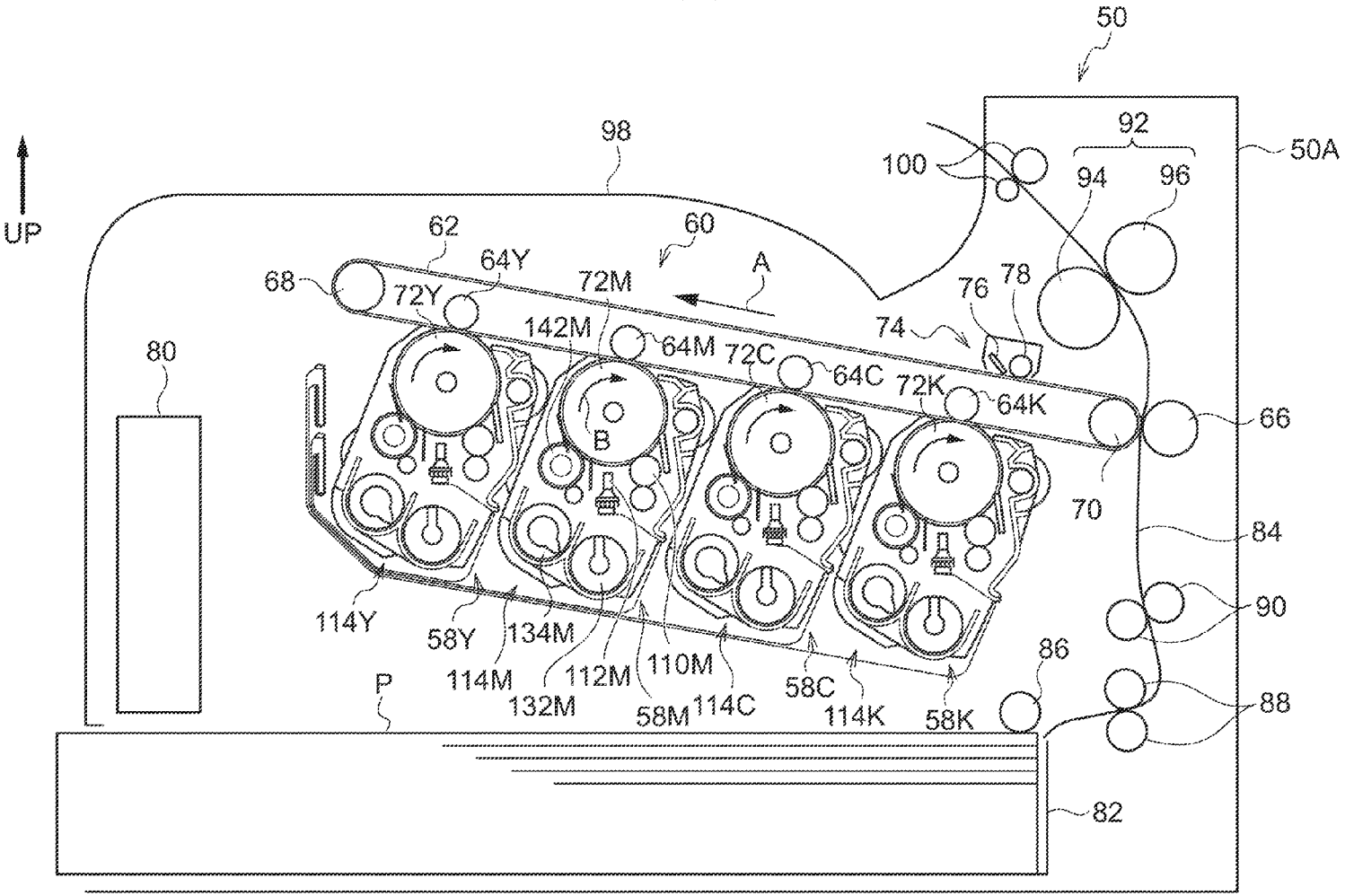
FIG. 5 is a schematic diagram showing an image forming apparatus according to an exemplary embodiment of the present invention.

As shown in FIG. 3, FIG. 4 and FIG. 5, four image forming units 58 (58Y, 58M, 58C, 58K) for forming toner images corresponding to each of the colors Y, M, C, K are disposed inside the apparatus main body 50A of the image forming apparatus 50, inclined with respect to the horizontal direction. Note that in this exemplary embodiment the developer (toner) is a non magnetic type of toner mixed with a magnetic carrier.

A transfer section 60 is provided above the image forming units 58Y, 58M, 58C, 58K. The transfer section 60 includes: an endless intermediate transfer belt 62; four primary transfer rolls 64Y, 64M, 64C, 64K disposed at the inside of the intermediate transfer belt 62 for transferring each of toner images formed on the each of the image forming units 58Y, 58M, 58C, 58K onto the intermediate transfer belt 62; and a secondary transfer roll 66 for transferring toner images that have been superimposed on each other on the intermediate transfer belt 62 onto a sheet member P, serving as a recording medium.

The intermediate transfer belt 62 is entrained with a constant tension between a tensioning roll 68 that imparts tension to the intermediate transfer belt 62 and a drive roll 70 disposed facing the secondary transfer roll 66 and driven by a motor, not shown in the drawings. Configuration is made such that the intermediate transfer belt 62 is moved in the arrow A direction of FIG. 5 (anticlockwise direction) by the drive roll 70.

In addition, image holding bodies 72 (72Y, 72M, 72C, 72K), described later, are disposed in the image forming units 58 facing the primary transfer rolls 64, with the intermediate transfer belt 62 disposed therebetween. Configuration is made such that a transfer bias voltage of opposite polarity to the toner polarity (for example positive polarity in the present exemplary embodiment) is applied to the primary transfer rolls 64 by electric supply units (not shown in the drawings). Configuration is made such that a transfer bias voltage of opposite polarity to the toner polarity is also applied to the secondary transfer roll 66 by an electric supply unit.

A cleaning device 74 is provided at the outer peripheral face of the intermediate transfer belt 62, between the tensioning roll 68 and the drive roll 70. The cleaning device 74 includes a cleaning blade 76 for scraping off residual toner from the outer peripheral face of the intermediate transfer belt 62, and a conveying member 78 for conveying toner scraped off by the cleaning blade 76 to outside of the intermediate transfer belt 62.

A control unit 80 is also provided inside the apparatus main body 50A of the image forming apparatus 50 for controlling driving of each section of the image forming apparatus 50.

A paper supply section 82 housing sheet members P is provided below the image forming units 58 of each of the colors. A paper feed conveying path 84 is also provided for conveying the sheet member P housed in the paper supply section 82 upwards from one end portion of the paper supply section 82. On the paper feed conveying path 84 are provided: a feed roll 86 for feeding the sheet member P out from the paper supply section 82; separating rolls 88 employed for separating and conveying the sheet member P out one sheet at a time; and a positioning roll 90 for matching the conveying timing of the sheet member P to the movement timing of toner images on the intermediate transfer belt 62.

A fixing device 92 is also provide at the sheet member P conveying direction downstream side (referred to below simply as the "downstream side") of the secondary transfer roll 66, for fixing the toner images, transferred onto the sheet member P by the secondary transfer roll 66, onto the sheet member P by heat and pressure. The fixing device 92 includes a heated heating roll 94, and a pressure roll 96 in press contact with the heating roll 94.

Discharge roll 100 is provided at the downstream side of the fixing device 92, for discharging the sheet member P to which a toner image has been fixed by the fixing device 92 into a discharge section 98 provided at an upper portion of the image forming apparatus 50.

Explanation now follows regarding the image forming units 58. Explanation follows here regarding the image forming unit 58M, as an example. Since the image forming units 58Y, 58C, 58K corresponding to the other colors have a similar structure to that of the image forming unit 58M, further explanation is omitted. Each of the configuration members of the image forming unit 58M is shown with its suffix M omitted.

Figure 6:
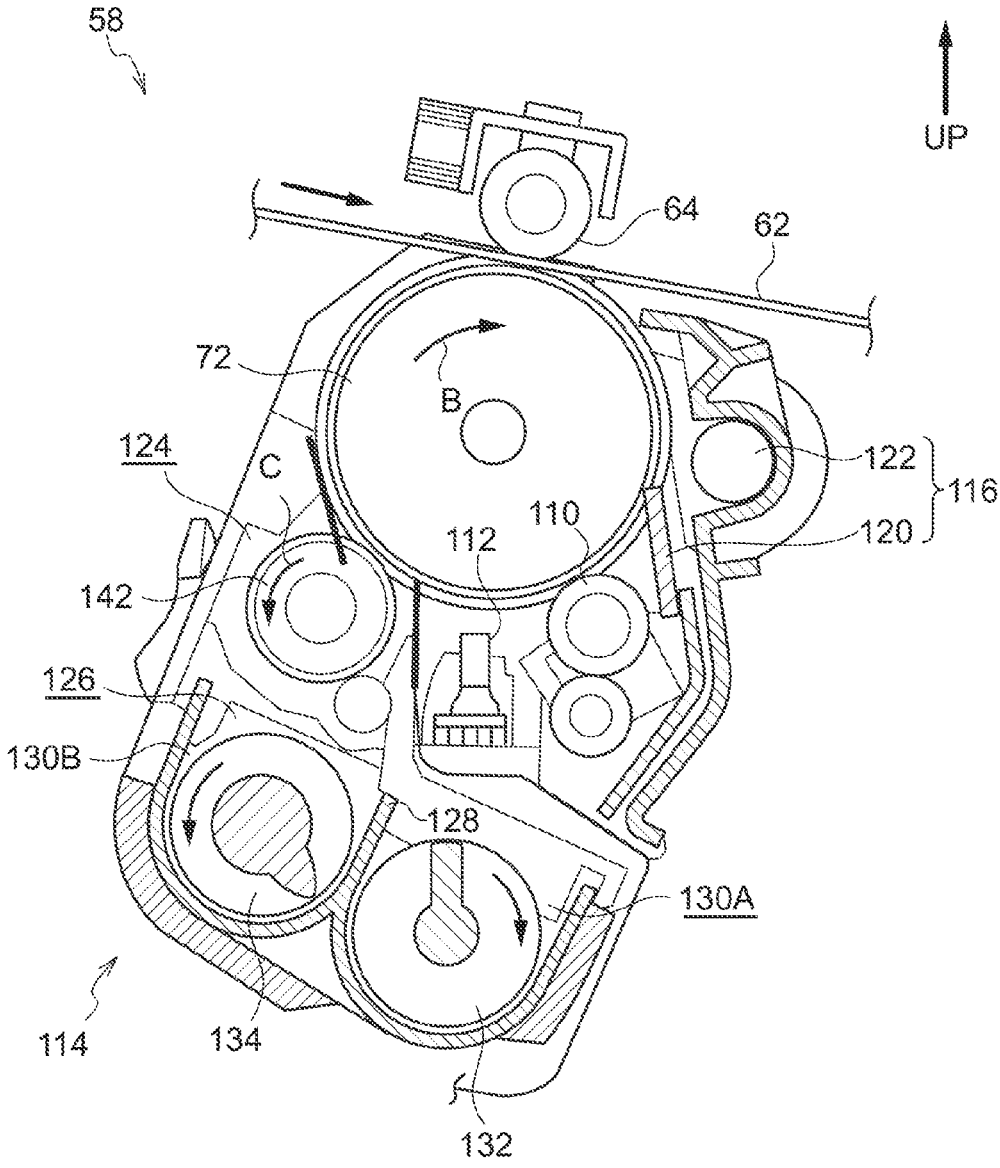
FIG. 6 is a side view showing an image forming unit employed in an image forming apparatus according to an exemplary embodiment of the present invention.

As shown in FIG. 4, FIG. 5, and FIG. 6, the image holding body 72 provided in the image forming unit 58 is rotationally driven in the arrow B direction (clockwise direction). Around the periphery of the image holding body 72 are provided: a charging roll 110 making contact with the surface of the image holding body 72 and uniformly charging the image holding body 72; an LED head 112 that illuminates exposure light onto the surface of the image holding body 72; a developing section 114 that develops a latent image formed on the image holding body 72 by the exposure light with a developer (toner) for each of the colors; a charge removing device (not shown in the drawings) that removes charge by illuminating light onto the image holding body 72 after the toner images have been transferred onto the intermediate transfer belt 62; and a cleaning device 116 that cleans the surface of the image holding body 72 after charge removal. The charging roll 110, the LED head 112, the developing section 114 and the cleaning device 116 are disposed facing the surface of the image holding body 72, in this sequence from the image holding body 72 rotation direction upstream side towards the downstream side.

As shown in FIG. 6, the cleaning device 116 includes: a plate shaped blade member 120 with an edge portion thereof making contact with the surface of the image holding body 72 and scraping off any remaining toner or the like on the surface of the image holding body 72; and a conveying member 122 that conveys remaining toner and the like that has been scraped off by the blade member 120 to outside of the image holding body 72 (to the outside into the page in FIG. 6).

The developing section 114 further includes a developer chamber 124, and an agitation and conveying chamber 126 provided below the developer chamber 124. The agitation and conveying chamber 126 agitates (mixes) toner supplied from the toner cartridge 52 (see FIG. 1 and FIG. 2) and conveys the toner into the developer chamber 124.

The agitation and conveying chamber 126 is partitioned by a partition wall 128 projecting out from the bottom face, so as to provided two agitation paths in the agitation and conveying chamber 126, a first agitation path 130A and a second agitation path 130B. A first connection opening and a second connection opening (not shown in the drawings) are formed as openings in positions at the two end of the partition wall 128, and the first agitation path 130A and the second agitation path 130B are connected together by the first connection opening and the second connection opening. The top face of the second agitation path 130B is open and connected to the developer chamber 124.

A first agitation and conveying member 132 for agitating and conveying developer is disposed in the first agitation path 130A, and a second agitation and conveying member 134 for agitating and conveying developer is disposed in the second agitation path 130B.

Figure 7:
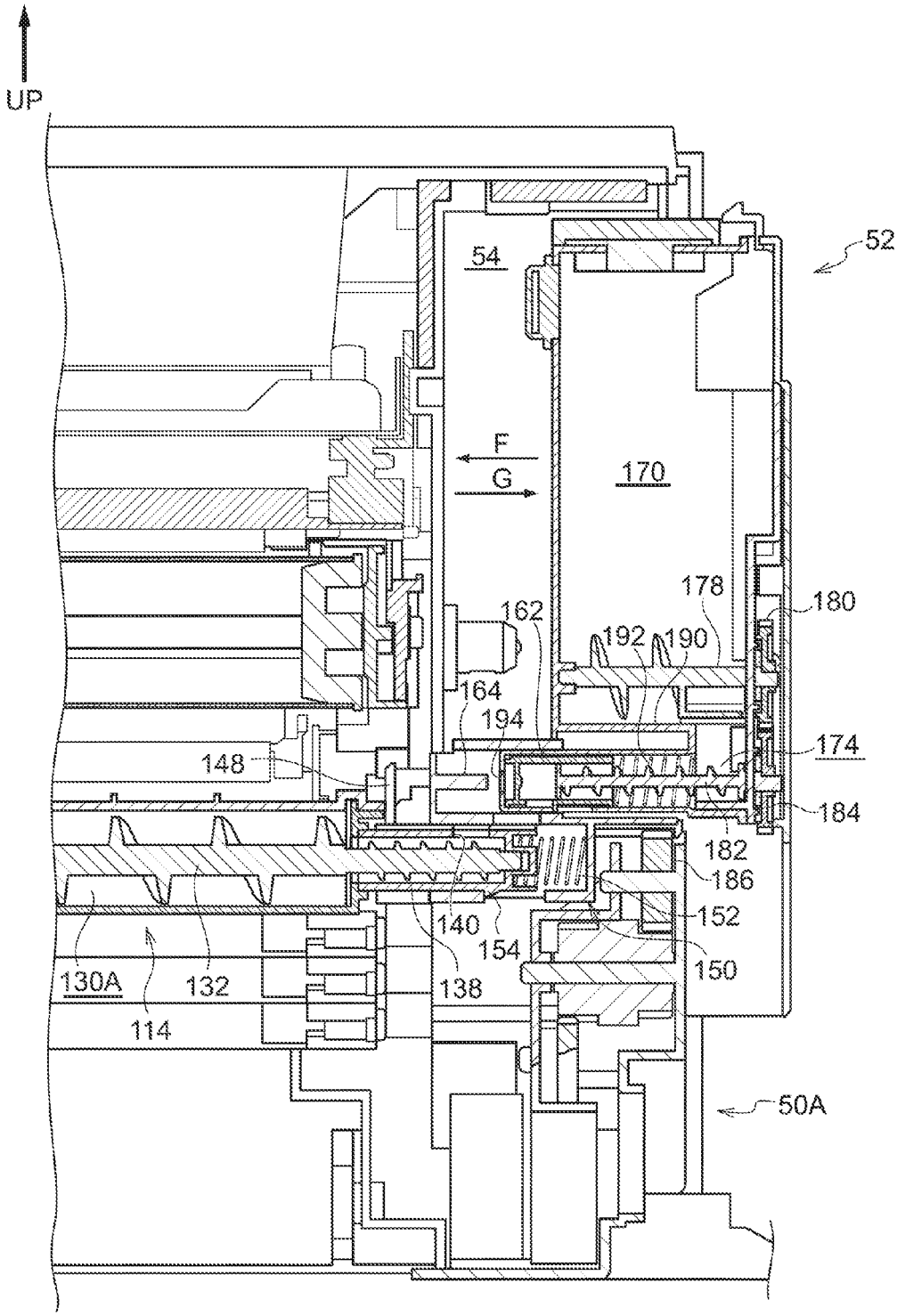
FIG. 7 is a cross-section showing a detached state of a toner cartridge and an image forming apparatus main body, according to an exemplary embodiment of the present invention.
Figure 8:
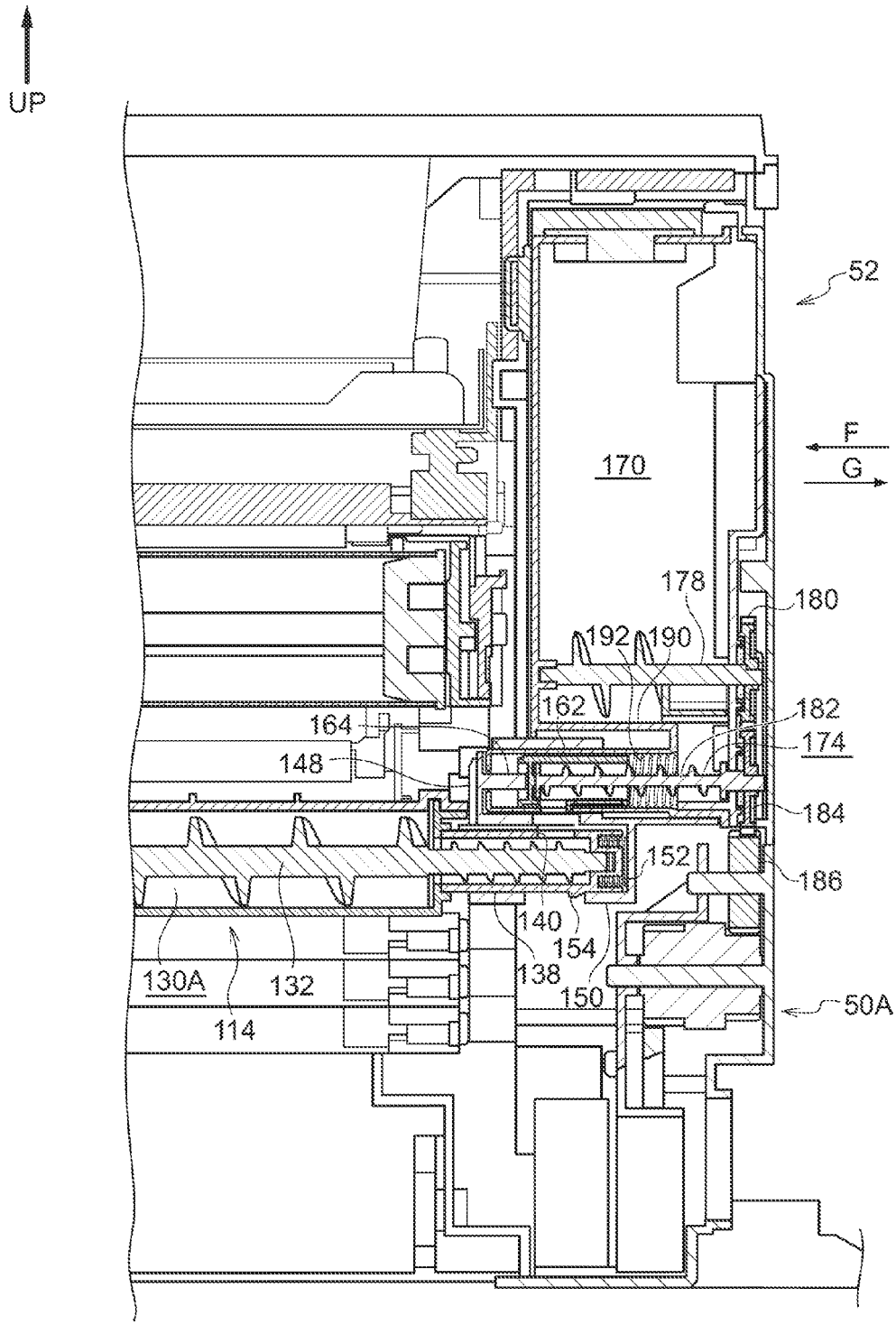
FIG. 8 is a cross-section showing a mounted state of a toner cartridge and an image forming apparatus main body, according to an exemplary embodiment of the present invention.

Furthermore, as shown in FIG. 7 and FIG. 8, a projecting section 138 is formed at one end of the first agitation path 130A, so as to project out towards the outside further than the end face of the first agitation path 130A, and an opening 140 is formed on the top face of the projecting section 138, with toner is supplied from the toner cartridge 52 into the opening 140.

As shown in FIG. 6, configuration is made such that the first agitation and conveying member 132 and the second agitation and conveying member 134 are driven by a drive section including a motor and gears, not shown in the drawings. Configuration is made such that the developer inside the agitation and conveying chamber 126 is mixed with toner supplied from the toner cartridge 52 (see FIG. 1 and FIG. 2), and circulated around the first agitation path 130A and the second agitation path 130B.

The developer chamber 124 is connected to the second agitation path 130B, and a developer roll 142 is provided in the developer chamber 124 with its axial direction along the length direction of the image holding body 72, rotating in the arrow C direction (anticlockwise direction). The developer roll 142 is disposed with its outer peripheral face facing the image holding body 72 through an opening section (not shown in the drawings) formed in the developer chamber 124. A bias voltage is applied across the developer roll 142 and the image holding body 72, forming an electric field therebetween.

According to this configuration, developer is supplied from the second agitation and conveying member 134 onto the surface of the developer roll 142, and toner in the developer supplied onto the surface of the developer roll 142 moves towards the latent image on the rotating image holding body 72. The latent image formed on the image holding body 72 is thus developed as a toner image.

Relevant Configuration Portions

Explanation now follows regarding toner cartridges and a mounting structure therefor.

Explanation follows regarding the toner cartridge 52M, as an example. The structure of the toner cartridges 52Y, 52C is similar to that of the toner cartridge 52M (see FIG. 9). In contrast, as shown in FIG. 10, the toner cartridge 52K for black is made larger than the other toner cartridges 52Y, 52M, 52C in consideration of the amount of black toner consumed. However, further explanation is omitted since the principles of the attaching and detaching mechanism to the apparatus main body 50A are similar for all of the toner cartridges 52Y, 52M, 52C, 52K. The suffix M is omitted from each of the configuration members of the toner cartridge 52M in the explanation.

As shown in FIG. 1, FIG. 2, FIG. 7 and FIG. 8, configuration is made such that the toner cartridge 52 is attached to the apparatus main body 50A by being pushed in towards the toner cartridge housing section 54 in the mounting direction F (the arrow F direction shown in FIG. 7 and FIG. 8), and is detached from the apparatus main body 50A by pulling out from the toner cartridge housing section 54 in the detaching direction G (the arrow G direction shown in FIG. 7 and FIG. 8).

As shown in FIG. 7, FIG. 8, FIG. 11A and FIG. 11B, the developing section 114 is provided with: a projecting section 138 projecting out to the outside of the first agitation path 130A; a developing section shutter 150 (150Y, 150M, 150C, 150K)(see FIG. 3) that slides along the length direction of the projecting section 138 with respect to the projecting section 138 and opens and closes the opening 140; a coil spring 152 biasing the developing section shutter 150 in the detaching direction G; a stopper 148 that limits the movement range of the developing section shutter 150 in the mounting direction F; and a stopper 154 that limits the movement range of the developing section shutter 150 in the detaching direction G.

The developing section shutter 150 includes a shutter lower section 156 with a bottomed circular cylindrical shape covering the outer periphery of the projecting section 138, and a shutter upper section 158 also of a bottomed circular cylindrical shape, provided above the shutter lower section 156 and formed integrally to the shutter lower section 156 (see FIG. 3).

In the shutter upper section 158, a projecting portion 164 is formed in a bar shape contacting a bottom section of a cartridge shutter 162 serving as an opening and closing member of bottomed circular cylindrical shape, described later. The above coil spring 152 makes contact with the inside in the shutter lower section 156. More precisely, the coil spring 152 is disposed in a compressed state between the leading end of the projecting section 138 and the bottom section of the shutter lower section 156. Bias force of the coil spring 152 is thereby imparted to the shutter lower section 156.

The opening 140 is formed in an upper portion of the projecting section 138 of the developing section 114, into which toner is supplied from the toner cartridge 52. An opening 166 is formed in the partitioning wall between the shutter lower section 156 and the shutter upper section 158, through which toner passes for supply to the developing section 114.

The placement position of the opening 166 is determined such that when the developing section shutter 150 abuts the stopper 148, the opening 166 overlaps with the opening 140, opening the opening 140, and when the developing section shutter 150 abuts the stopper 154, the opening 166 is separated from the opening 140 such that the opening 140 is closed.

More precisely, when the toner cartridge 52 is not in the mounted state to the apparatus main body 50A (see FIG. 11A), the developing section shutter 150 is moved in the detaching direction G due to bias force of the coil spring 152 and abuts the stopper 154, the opening 166 is separated from the opening 140, and the opening 140 is closed.

However, when the toner cartridge 52 is mounted to the apparatus main body 50A (FIG. 11B), the projecting portion 164 is pressed by the cartridge shutter 162 and the developing section shutter 150 moves in the mounting direction F and contacts the stopper 148, the opening 166 and the opening 140 overlap with each other, such that the opening 140 is opened.

A cover portion 200 is integrally formed to a partitioning wall 157 between the shutter upper section 158 and the shutter lower section 156, projecting out in the detaching direction G and covering at least a portion of a cog wheel 186 (see FIG. 3).

More precisely, in a state in which the toner cartridge 52 is not mounted to the apparatus main body 50A (see FIG. 11A), the developing section shutter 150 moves in the detaching direction G due to bias force of the coil spring 152, abuts the stopper 154, such that the cover portion 200 covers substantially all of the upper portion of the cog wheel 186 (see FIG. 2).

However, when the toner cartridge 52 is in a mounted state to the apparatus main body 50A (FIG. 11B), the projecting portion 164 is pressed by the cartridge shutter 162 and the developing section shutter 150 is moved in the mounting direction F and abuts the stopper 148. Accordingly, an upper portion of the cog wheel 186 is exposed by movement of the cover portion 200, such that a cog wheel 184, described below, provided to the toner cartridge 52 and the cog wheel 186 mesh together.

Figure 9:
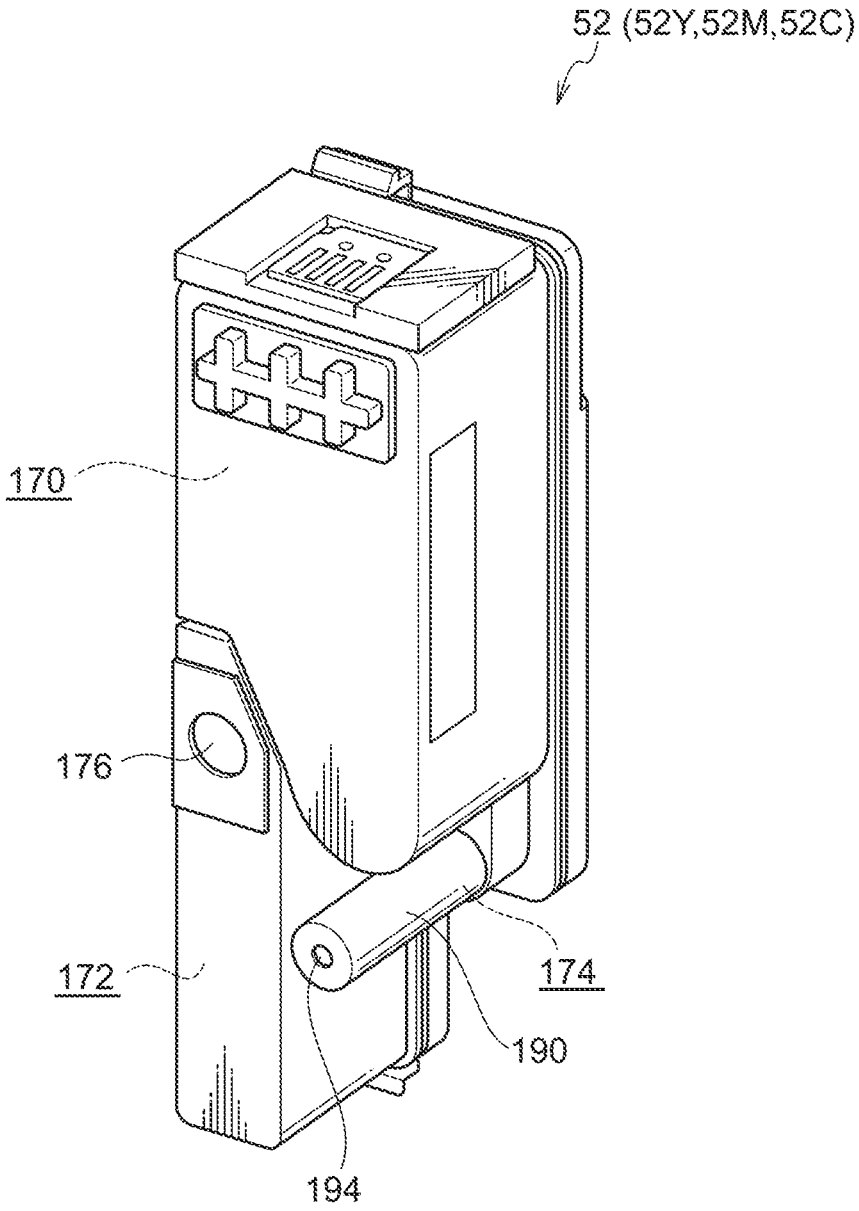
FIG. 9 is a perspective view showing a toner cartridge employed in an image forming apparatus according to an exemplary embodiment of the present invention.
Figure 10:
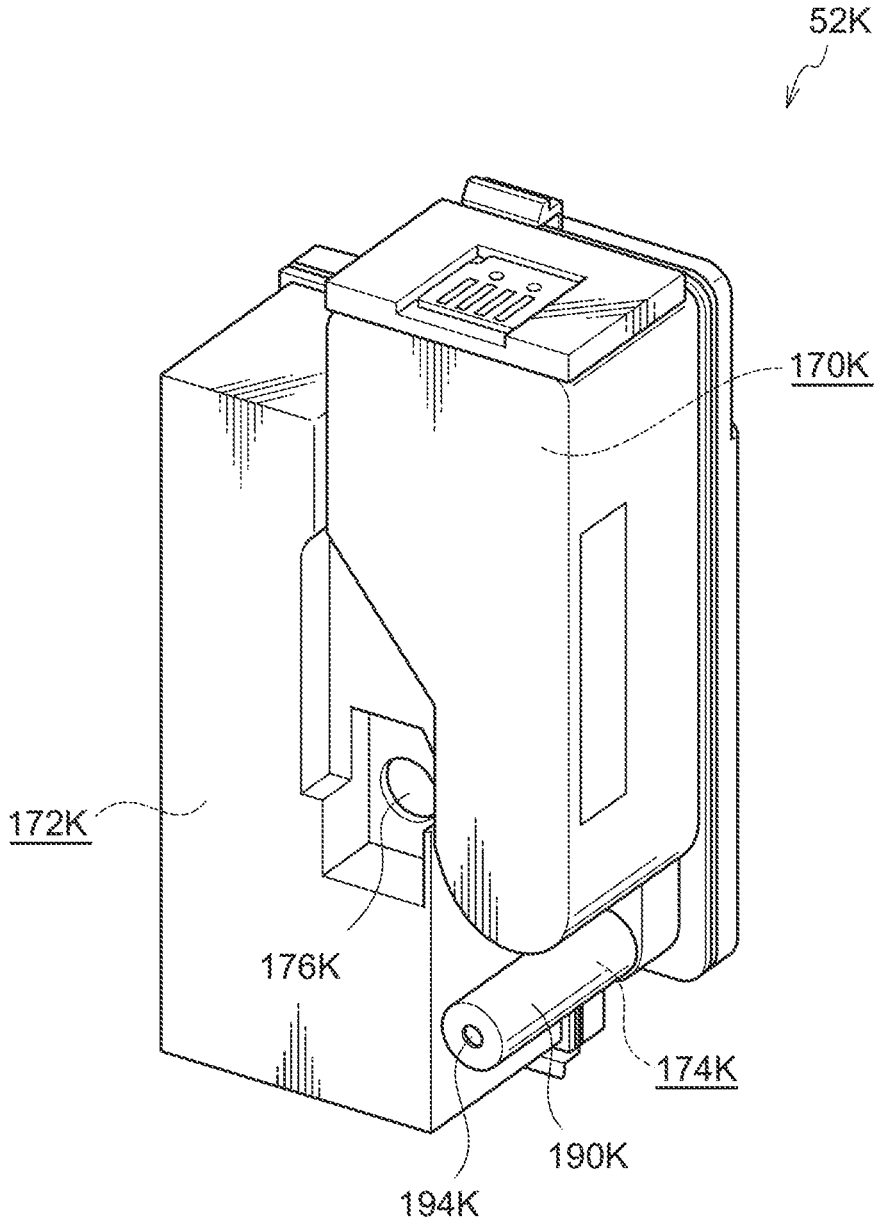
FIG. 10 is a perspective view showing a toner cartridge employed in an image forming apparatus according to an exemplary embodiment of the present invention.

As shown in FIG. 9 and FIG. 10, inside the toner cartridge 52 are provided: a toner holding chamber 170 holding new toner for supply to the developing section 114, a toner discharge chamber 172 into which waste toner discharged from the developing section 114 (see FIG. 6) is discharged; and a toner feed chamber 174 disposed below the toner holding chamber 170 for feeding toner held in the toner holding chamber 170 to the developing section 114.

A reception inlet 176 is provided in a wall face of the toner discharge chamber 172 on the apparatus main body 50A side. The reception inlet 176 is connected to the cleaning device 116 (see FIG. 6) when the toner cartridge 52 is mounted to the apparatus main body 50A, and waste toner conveyed by the conveying member 122 is received through the reception inlet 176.

Furthermore, as shown in FIG. 7 and FIG. 8, an agitation member 178 is provided in the toner holding chamber 170, the agitation member 178 rotating and agitating stored toner. A cog wheel 180 is provided at one end of the agitation member 178, the cog wheel 180 rotating integrated to the agitation member 178.

An agitation and conveying member 182 is provided to the toner feed chamber 174 for conveying out toner to the developing section 114, while agitating the toner. The cog wheel 184 is provided to an end portion of the agitation and conveying member 182, meshing with the cog wheel 180 provided to the end portion of the agitation member 178. When the toner cartridge 52 is mounted to the apparatus main body 50A, a lower portion of the cog wheel 184 is externally exposed and meshes with an upper portion of the cog wheel 186 provided to the apparatus main body 50A.

Driving force of a motor (not shown in the drawings) is transmitted to, and rotates, the cog wheel 186 provided to the apparatus main body 50A. Due to the cog wheel 186 being rotated, driving force is transmitted through the cog wheel 184 and the cog wheel 180 to the agitation member 178 and the agitation and conveying member 182 of the toner cartridge 52 mounted to the apparatus main body 50A, so as to rotate the agitation member 178 and the agitation and conveying member 182. A one-way ratchet, not shown in the drawings, is provided on the rotation axis of the cog wheel 186, so as to be rotatable in one direction. Accordingly, the lower portion of the cog wheel 184 and the upper portion of the cog wheel 186 mesh smoothly.

Further, the toner feed chamber 174 is configured by a housing section 190, as one example of a tubular shaped section, having a bottomed circular cylindrical shape extending in the mounting direction F of the toner cartridge 52 (see FIG. 9 and FIG. 10). The above cartridge shutter 162 is further provided to the toner feed chamber 174 so as to slide along the inside peripheral face of the housing section 190 and be moveable along the length direction (axial direction) of the toner feed chamber 174, and a coil spring 192 is provided for biasing the cartridge shutter 162 in the mounting direction F.

An opening hole 194 is formed in the bottomed section of the housing section 190, into which the projecting portion 164 provided to the developing section shutter 150 is inserted when the toner cartridge 52 is mounted to the apparatus main body 50A. The bias force of the coil spring 192 biasing the cartridge shutter 162 is stronger than the bias force of the coil spring 152 biasing the developing section shutter 150.

An opening 196 is provided in a lower portion of the cartridge shutter 162, and an opening 198 is provided as an example of a hole in the lower portion of the housing section 190. The placement positions of the opening 196 and the opening 198 are set such that the opening 196 and the 198 overlap with each other when the toner cartridge 52 has been mounted to the apparatus main body 50A.

More precisely, in a state in which the toner cartridge 52 is not mounted to the apparatus main body 50A (see FIG. 11A), the cartridge shutter 162 is moved in the mounting direction F with respect to the housing section 190 by the bias force of the coil spring 192, the cartridge shutter 162 abuts the bottom section of the housing section 190 (namely, the rib 202 abuts one end of the opening 198 in the housing section 190), and the opening 196 is separated from the opening 198, so as to close the opening 198.

However, when the toner cartridge 52 is in a mounted state to the apparatus main body 50A (FIG. 11B), the cartridge shutter 162 presses the shutter upper section 158, moving the developing section shutter 150 in the mounting direction F, and the opening 166 and the opening 140 overlap with each other. Furthermore, the cartridge shutter 162 is pressed by the projecting portion 164 and moves relative to the housing section 190 in the detaching direction G (namely, the rib 202, described later, moves to the other end of the opening 198 in the housing section 190), such that the opening 196 overlaps with the opening 198, opening the opening 198. Then, in this state, the opening 196 and the opening 198 overlap with the opening 140 and the opening 166.

An interlock is also disengaged by mounting all of the toner cartridges 52 to the apparatus main body 50A, such that the image forming apparatus 50 is made operable.

Operation

Explanation now follows regarding a mounting method of the toner cartridge 52 and a detaching method thereof.

As shown in FIG. 2, in order to mount the toner cartridges 52 to the apparatus main body 50A, the cover 55 of the image forming apparatus 50 is opened, and the toner cartridge 52 is held in a position ready for mounting.

Figure 11A:
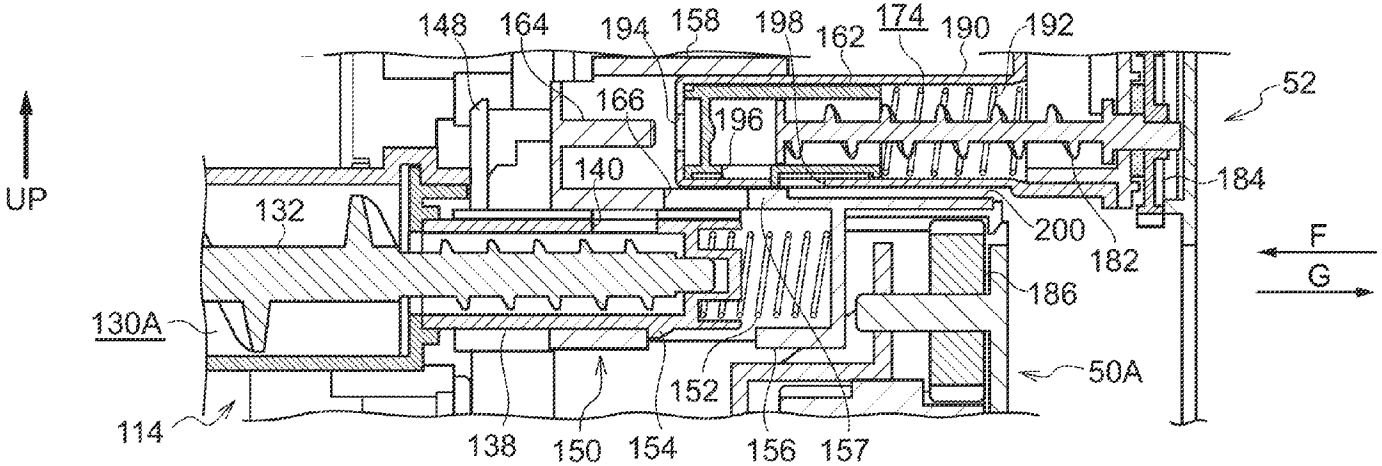
FIGS. 11A and 11B are enlarged cross-sections showing, respectively, a detached state and an mounted state of a toner cartridge and an image forming apparatus main body, according to an exemplary embodiment of the present invention.
Figure 12A:
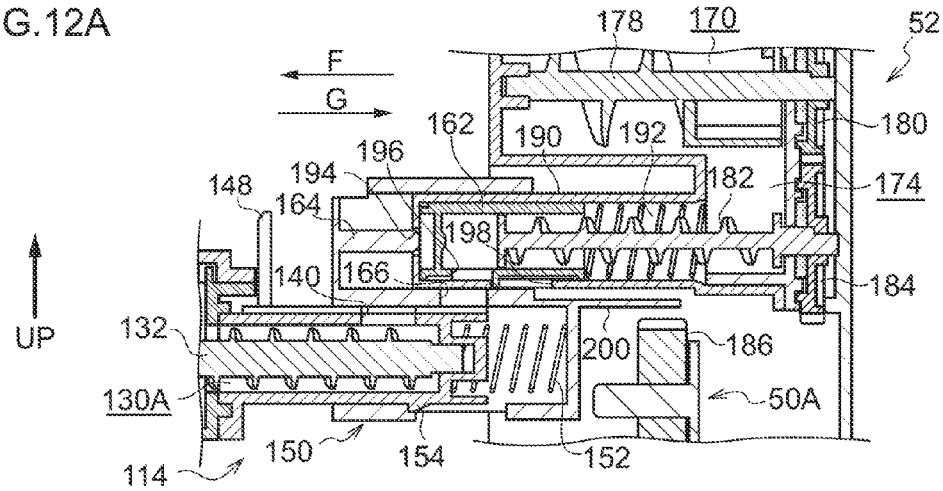
FIG. 12A to 12C are operational explanatory diagrams showing an operation to mount a toner cartridge to an image forming apparatus main body, according to an exemplary embodiment of the present invention.

Then, as shown in FIG. 11A and FIG. 12A, the toner cartridge 52 is moved in the mounting direction F, and the shutter upper section 158 of the developing section shutter 150 is inserted into the housing section 190 of the toner cartridge 52.

When the housing section 190 of the toner cartridge 52 is inserted into the shutter upper section 158 of the developing section shutter 150, the projecting portion 164 of the developing section shutter 150 passes through the opening hole 194 of the housing section 190, and abuts the bottom section of the cartridge shutter 162. Bias force of the coil spring 152 biasing the developing section shutter 150 is weaker than the bias force of the coil spring 192 biasing the cartridge shutter 162. Accordingly, the developing section shutter 150 is pressed by the cartridge shutter 162, moving the developing section shutter 150 in the mounting direction F.

Figure 12B:
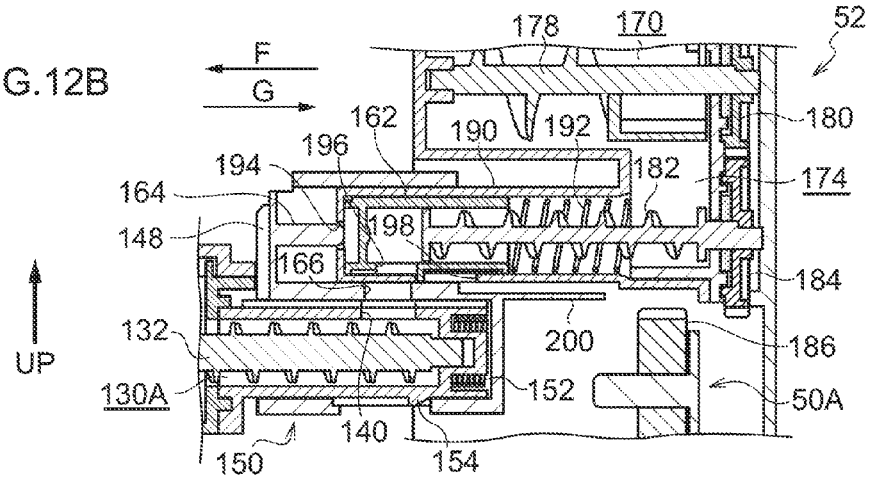

When the developing section shutter 150 has moved in the mounting direction F and the shutter upper section 158 of the developing section shutter 150 abuts the stopper 148, the opening 166 of the developing section shutter 150 overlaps with the opening 140 of the projecting section 138, as shown in FIG. 12B. The cover portion 200 covering over the cog wheel 186 also moves in the mounting direction F, exposing the upper portion of the cog wheel 186, and enabling meshing of the cog wheel 186 and the cog wheel 184.

When the toner cartridge 52 is moved further in the mounting direction F, the cartridge shutter 162 pressed by the projecting portion 164 moves relative to the housing section 190 in the detaching direction G.

Figure 11B:
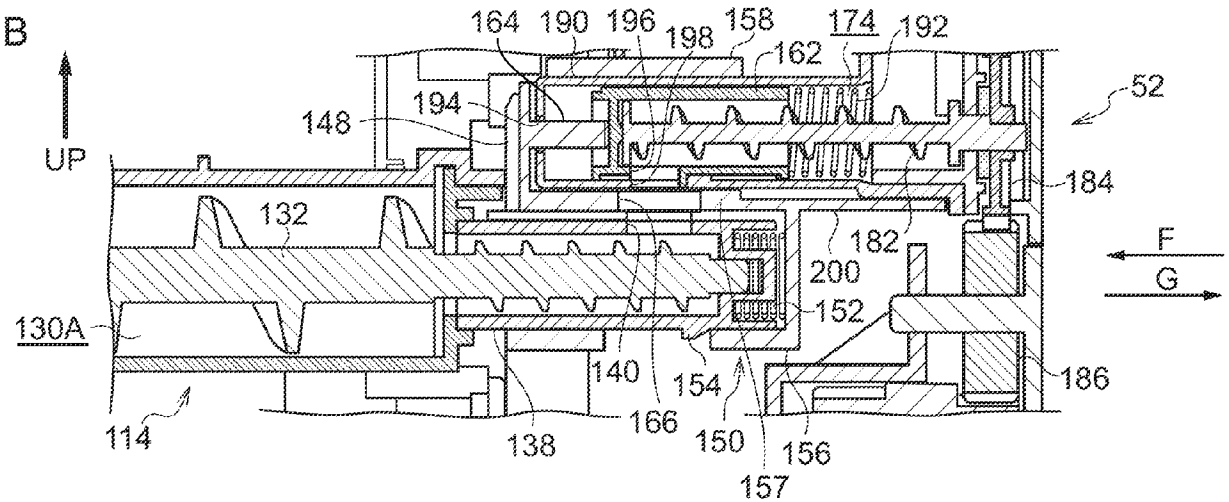
Figure 12C:
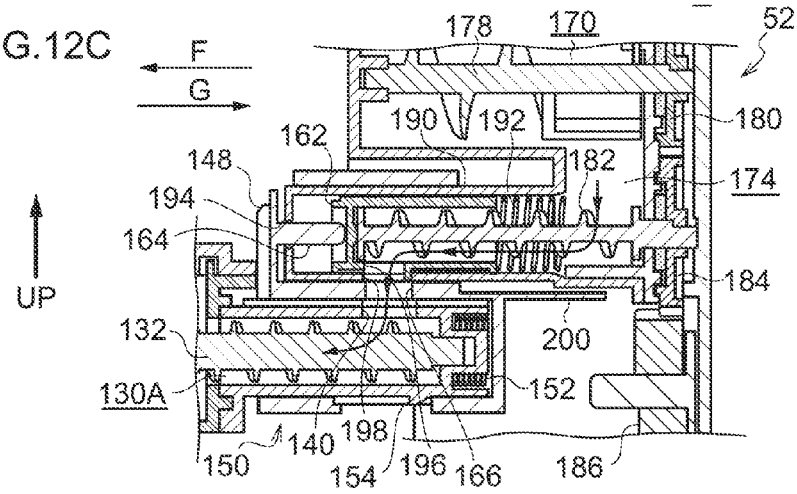

When the toner cartridge 52 has moved in the mounting direction F up to the point where mounting of the toner cartridge 52 is complete, as shown in FIG. 12C, FIG. 11B and FIG. 8, the opening 196 of the cartridge shutter 162 and the opening 198 in the housing section 190 overlap with each other.

Furthermore, the opening 198 in the housing section 190 is moved above the opening 140 of the projecting section 138, and as a result the opening 140, the opening 166, the opening 198, and the opening 196 all overlap with each other in the vertical direction. This completes mounting of the toner cartridge 52.

By completing mounting of the toner cartridge 52, the upper portion of the cog wheel 186 and the cog wheel 184 mesh with each other, enabling driving force transmission between the cog wheel 186 and the cog wheel 184.

The interlock is then disengaged, by rotating the cog wheel 186 with a motor, not shown in the drawings, the cog wheel 184 and the cog wheel 180 provided to the toner cartridge 52 are rotated, and accordingly the agitation and conveying member 182 and the agitation member 178 are also rotated. By rotating the agitation and conveying member 182 and the agitation member 178, the toner housed in the toner holding chamber 170 of the toner cartridge 52 is agitated. The toner supplied to the toner feed chamber 174 is agitated and conveyed, falls into the projecting section 138 through the overlapping opening 140, opening 166, opening 198 and opening 196, and is supplied into the developing section 114.

In order to detach the apparatus main body 50A from the toner cartridge 52, the above processes are performed in reverse, and the toner cartridge 52 is detached from the apparatus main body 50A.

Detailed explanation now follows regarding the cartridge shutter 162 and the housing section 190 of the toner cartridge 52.

Figure 13:
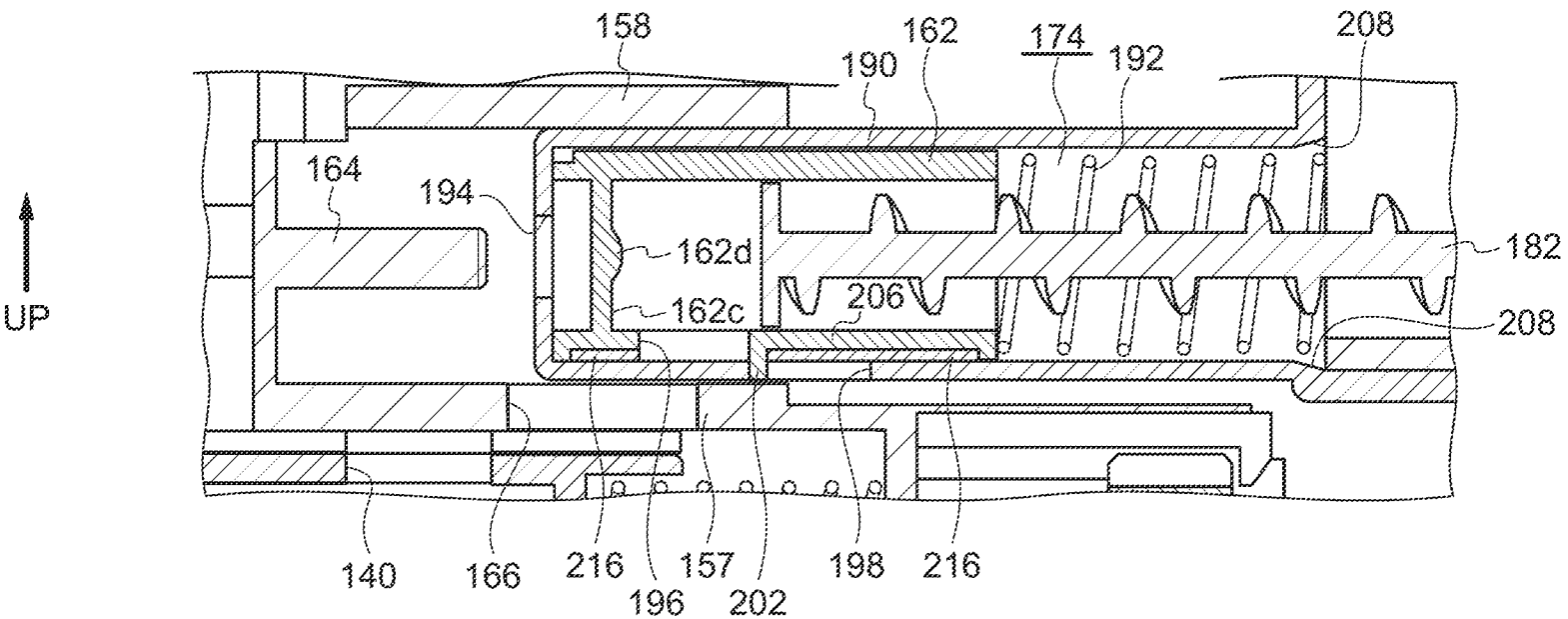
FIG. 13 is an enlarged diagram showing an enlargement of locations at the periphery of the housing section of FIG. 11A.
Figure 14:
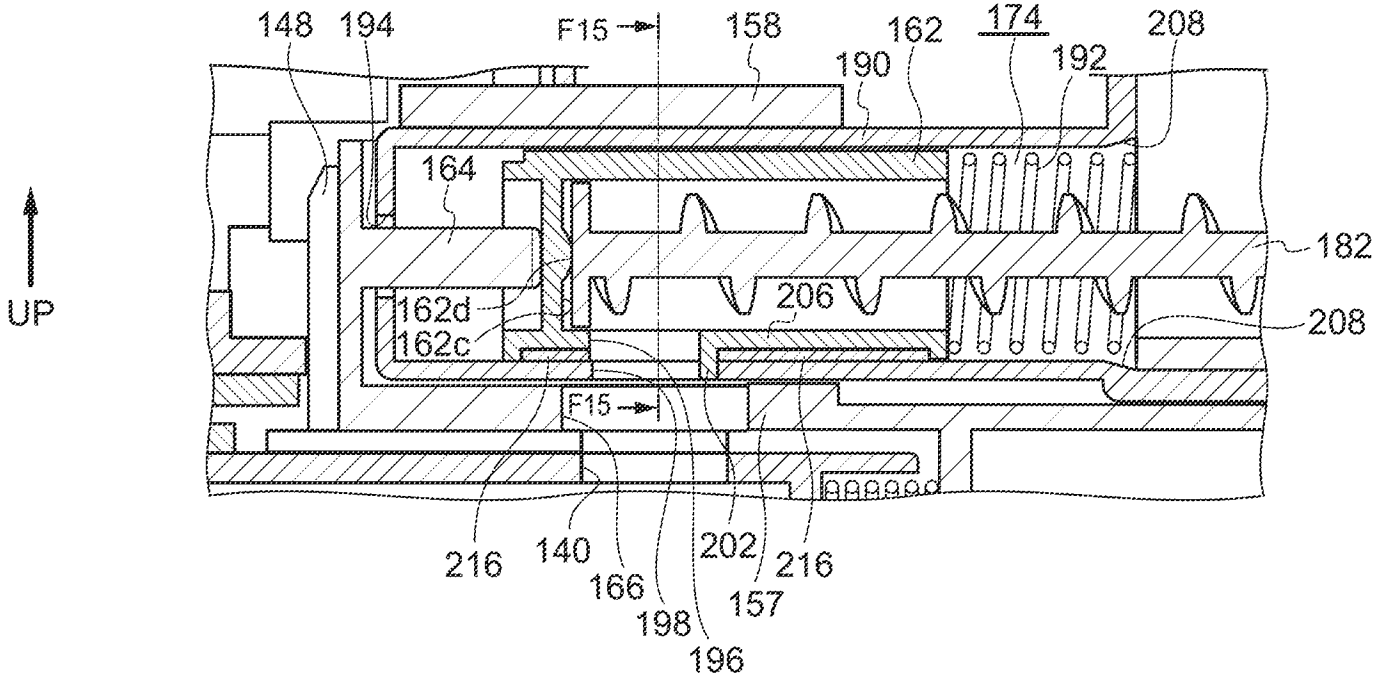
FIG. 14 is an enlarged diagram showing an enlargement of locations at the periphery of the housing section of FIG. 11B.
Figure 15:
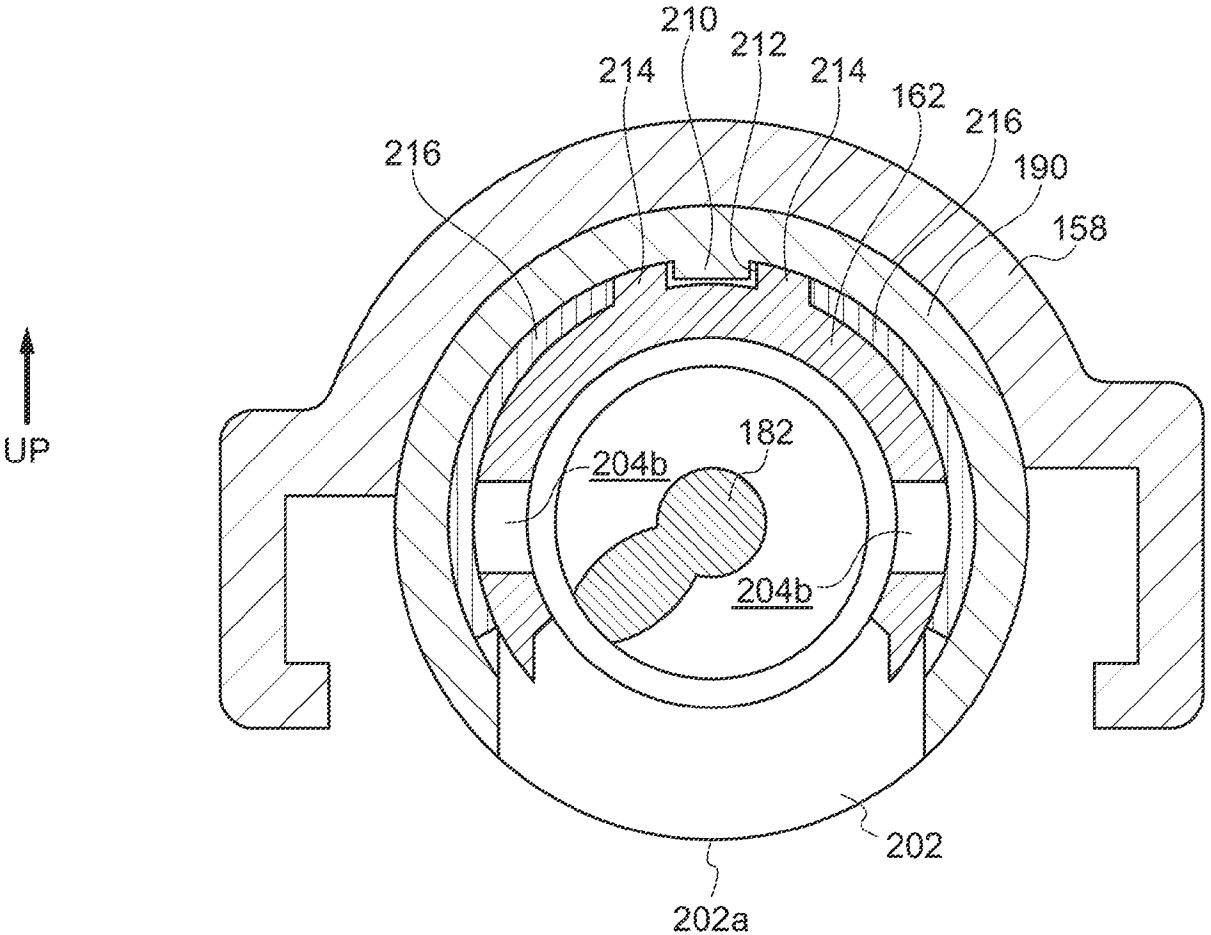
FIG. 15 is a cross-section taken on line F15-F15 of FIG. 14.
Figure 16:
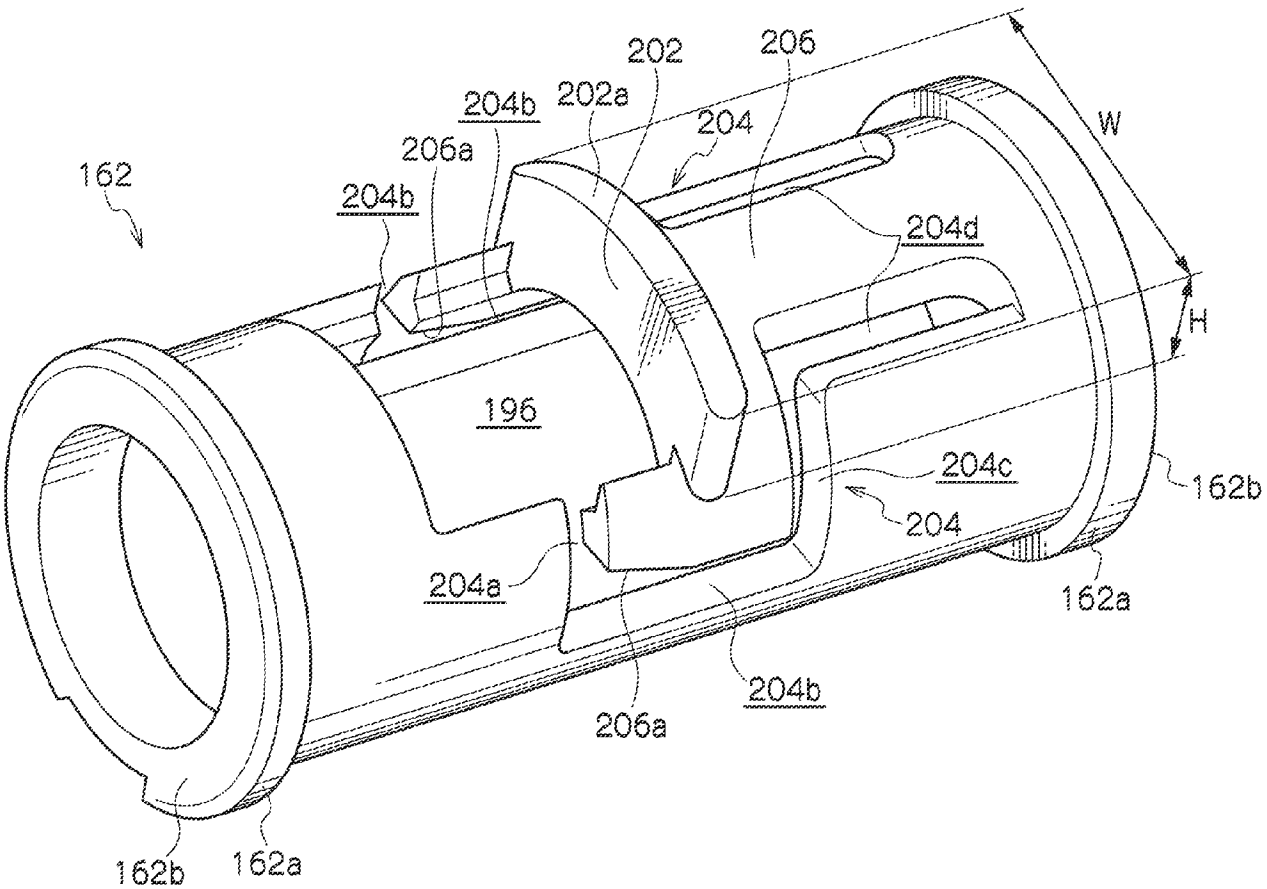
FIG. 16 is a perspective view of a cartridge shutter.
Figure 17A:
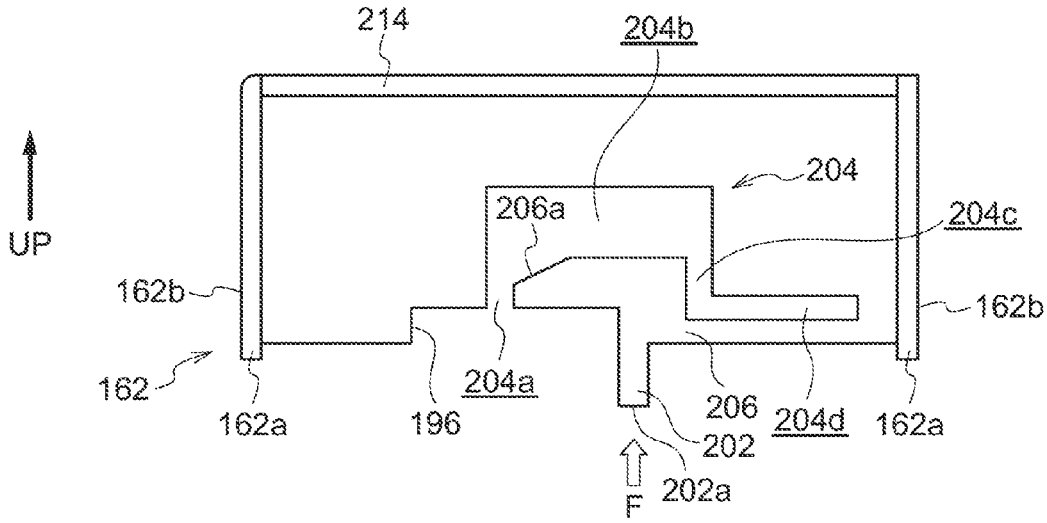
FIGS. 17A and 17B are explanatory diagrams showing a deformation mode of a cartridge shutter, as viewed from the side of the cartridge shutter.
Figure 17B:
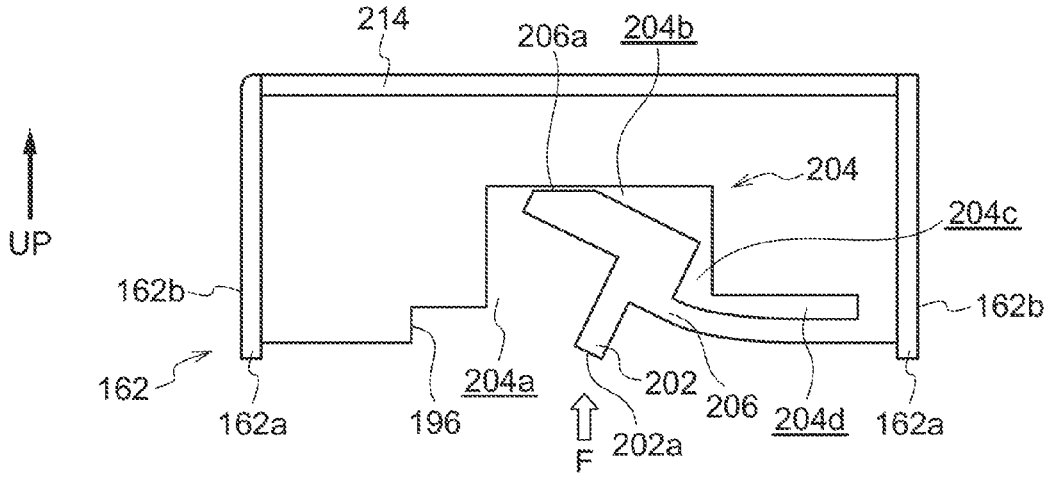
Figure 18A:
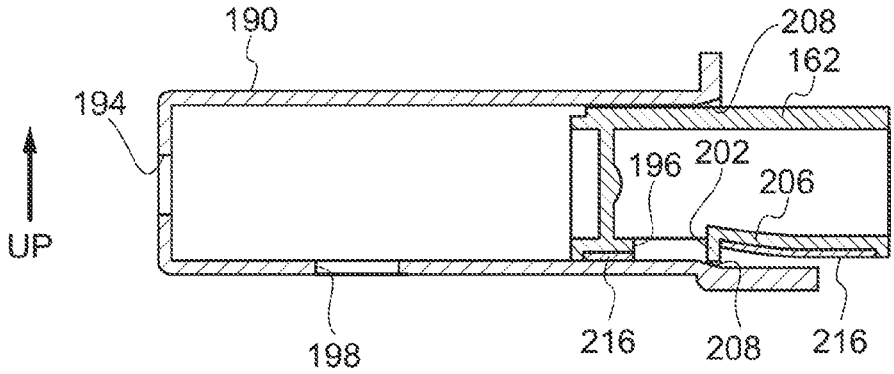
FIG. 18A to 18C are operational explanatory diagrams showing states when a cartridge shutter is being assembled to a housing section.
Figure 18B:
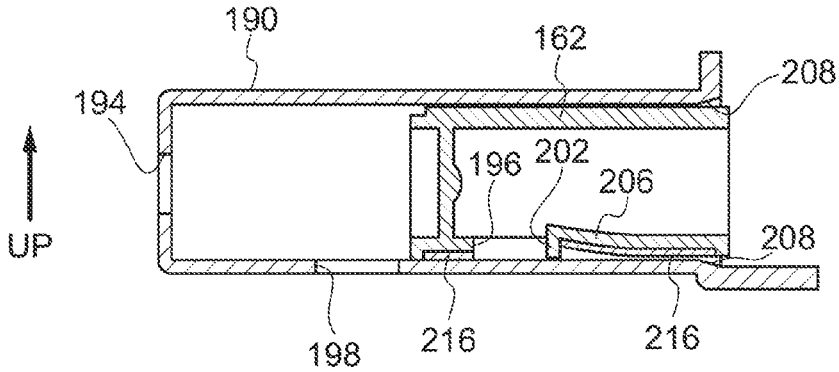
Figure 18C:
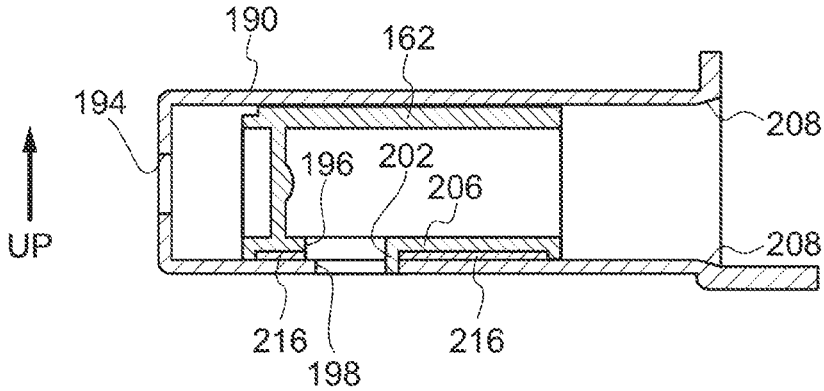
Figure 19:
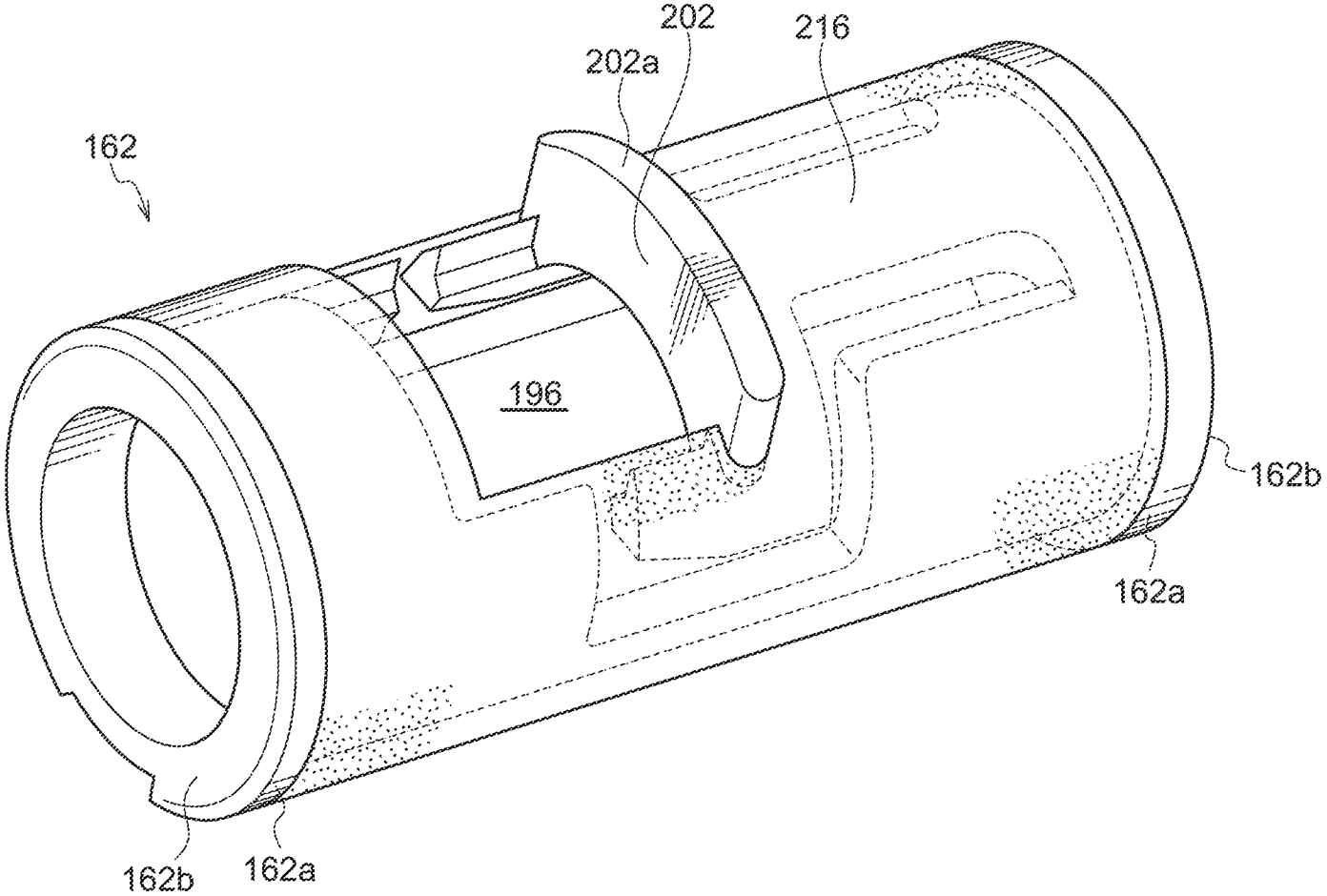
FIG. 19 is a diagram showing an attached state of a cover member to the cartridge shutter shown in FIG. 16.

FIG. 13 is an enlarged diagram showing an enlargement of the locations around the housing section 190 of FIG. 11A. FIG. 14 is an enlarged diagram showing an enlargement of the locations around the housing section 190 of FIG. 11B. FIG. 15 is a cross-section taken on line F15 to F15 in FIG. 14. FIG. 16 is a perspective view of the cartridge shutter 162. FIGS. 17A and 17B are side views of the cartridge shutter 162, for explaining a deformation mode of the cartridge shutter 162. FIG. 18A to FIG. 18C are explanatory diagrams showing states as the cartridge shutter 162 is being assembled to the housing section 190. FIG. 19 is a diagram showing a state in which a cover member 216, described later, has been affixed to the cartridge shutter 162 shown in FIG. 16.

As shown in FIG. 13 to FIG. 19, and particularly in FIG. 16, among the edges forming the opening 196, a rib 202, serving as an example of a projection portion, is provided to the cartridge shutter 162. The rib 202 projects out towards the outside from an edge along a direction orthogonal to the sliding direction of the cartridge shutter 162. The cartridge shutter 162 is formed from a resin material, and the rib 202 is integrally formed to the cartridge shutter 162.

The width W of the rib 202 (shown in FIG. 16) is set so as to correspond to the width of the opening 198 in the housing section 190 such that, as shown in FIG. 13, FIG. 14 and FIG. 18C, the rib 202 enters into the opening 198 in the housing section 190.

In the state in which the toner cartridge 52 is not mounted to the apparatus main body 50A, as shown in FIG. 13, the rib 202 abuts a first edge of the opening 198 in the housing section 190. However, in the state of FIG. 14 in which the toner cartridge 52 is mounted to the apparatus main body 50A, the rib 202 abuts a second edge of the opening 198 in the housing section 190.

The projection height H of the rib 202 (shown in FIG. 16) is set in a range such that when the rib 202 is has entered the opening 198 in the housing section 190, the rib 202 does not protrude out beyond the outer peripheral face of the housing section 190. Preferably the projection height H of the rib 202 is set at a height such that, as shown in FIG. 13 to FIG. 15, the rib 202 runs along the outer peripheral face of the housing section 190. The rib 202 thereby does not interfere with the partitioning wall 157 between the shutter lower section 156 and the shutter upper section 158.

When the toner cartridge 52 is being detached from the apparatus main body 50A, the rib 202 is moved from the second end of the opening 198 in the housing section 190 to the first end, toner adhered at the opening 198 in the housing section 190 is scraped off to fall onto the developing section 114 side. Consequently, even when there is toner adhered at the opening 198 in the housing section 190 when the toner cartridge 52 is being replaced, this toner is not brought out onto the exterior of the apparatus main body 50A, and the hands of the replacing operator and the cover 55 of the apparatus main body 50A are not soiled.

As shown in FIG. 16, FIG. 17A and FIG. 17B, there are two slits 204 in the cartridge shutter 162, serving as examples of a cutout. Each of the slits 204 is configured from: a first groove 204*a* cutout along the peripheral direction from the opening 196; a second groove 204*b* cutout along the axial direction from the first groove 204*a*; a third groove 204*c* cutout along the peripheral direction so as to turn back from the second groove 204*b*; and a fourth groove 204*d* cutout along the axial direction towards an end portion of the cartridge shutter 162 from the third groove 204*c*. The slits 204 are formed with axial symmetry to each other. The location surrounded by the two slits 204 configures a resilient tab 206 that is resiliently deformable towards the axial center of the cartridge shutter 162.

The rib 202 is provided projecting up from one side of the resilient tab 206 and, as shown in FIG. 17A and FIG. 17B, when external force F is imparted to the rib 202 towards the axial center, the rib 202 is depressed to the inside (the axial center side) of the cartridge shutter 162, such that the peak portion 202*a* of the rib 202 moves to inside the outer peripheral face of the cartridge shutter 162.

A sloping portion 206*a* is provided at an end portion of the resilient tab 206 on the second groove 204*b* side, such that the end portion of the resilient tab 206 on the second groove 204*b* side makes face contact with the main body side of the cartridge shutter 162 when the rib 202 is depressed inside the cartridge shutter 162. The external force F imparted to the rib 202 is received over a wider cross-section due to the sloping portion 206*a* making face contact with the main body side of the cartridge shutter 162.

As shown in FIG. 13, FIG. 14, and FIG. 18A to FIG. 18C, a sloping face 208 is formed to an inner peripheral face of the end portion of the housing section 190 configuring the opening for the cartridge shutter 162, to facilitate insertion of the cartridge shutter 162. When pushing the cartridge shutter 162 inside the housing section 190 during assembly, the rib 202 of the cartridge shutter 162 slides along the sloping face 208, the rib 202 receives external force F towards the axial center, and is depressed in towards the inside (axial center side). The cartridge shutter 162 can thereby be inserted right inside the housing section 190.

As shown in FIG. 18A to FIG. 18C, as the cartridge shutter 162 is being inserted inside the housing section 190, when the rib 202 reaches the opening 198 in the housing section 190, the rib 202 reverts from its depressed state so as to enter into the opening 198, thereby completing assembly of the cartridge shutter 162 to the housing section 190.

Accordingly, even though the rib 202 is provided projecting out from the outer peripheral face of the cartridge shutter 162 in order to scrape off toner adhered at the opening 198 in the housing section 190, due to the rib 202 being movable from outside to enter the opening 198 in the housing section 190 due to the resilient tab 206, the cartridge shutter 162 is easily assembled to the housing section 190.

As shown in FIG. 15, a guide rail 210 and a guide groove 212, serving as an example of a guiding section, are provided between the inner peripheral face of the housing section 190 and the outer peripheral face of the cartridge shutter 162. Specifically, the single guide rail 210 is provided running along the axial direction at an upper portion on the inner peripheral face of the housing section 190 on the opposite side to that of the opening 198. The guide groove 212 is formed between two guide ribs 214 provided along the axial direction at an upper portion on the outer peripheral face of the cartridge shutter 162 on the opposite side to that of the rib 202.

When inserting the cartridge shutter 162 inside the housing section 190 during assembly, the cartridge shutter 162 is inserted in a peripheral direction positioned state with respect to the housing section 190 due to the guide rail 210 of the cartridge shutter 162 passing through the guide groove 212 of the housing section 190. Accordingly, the rib 202 enters into the opening 198 at the opposite side to that of the guide rail 210 and the guide groove 212.

Note that configuration may be made with the guide rail 210 provided to the outer peripheral face of the cartridge shutter 162, and the guide groove 212 provided to the inner peripheral face of the housing section 190.

Furthermore, as shown in FIG. 19, the cover member 216 formed from a thin sponge material is attached to the outer peripheral face of the cartridge shutter 162. Specifically, the cover member 216 is attached between flange portions 162*a* at the two ends of the cartridge shutter 162, and is formed so as to expose portions corresponding to the opening 196, the rib 202, the guide groove 212 and the guide ribs 214. Toner is prevented from leaking from the slits 204 by covering the portions corresponding to the slits 204 with the cover member 216.

The attached surface area of the cover member 216 is made larger than in a comparative example (a cartridge shutter formed without the rib 202 in which, to close the opening 198 in the housing section 190, the cartridge shutter is slid in until the edge of the opening 196 of the cartridge shutter 162 has passed the edge of the opening 198 in the housing section 190 (until the edge of the opening 196 is overlapped with the opening 198)), and the cover member 216 is protected by the flange portions 162*a*. Consequently, the cover member 216 is not peeled off from the cartridge shutter 162 even when the cartridge shutter 162 is slid inside the housing section 190. Consequently, there is no need for the cover member 216 to cover around as far as a bottom section 162*b* of the cartridge shutter 162.

Note that the reason it is made possible to set the attached surface area of the cover member 216 greater than that of a comparative example is in order to design a longer overall length of the cartridge shutter 162 to compensate for the reduced sliding stroke of the cartridge shutter 162 due to provision of the rib 202 entered into the opening 198 in the housing section 190.

A projection 162*d* is also provided inside of the cartridge shutter 162 to a bottom face 162*c* of the cylinder, projecting out in a substantially hemispherical shape, as shown in FIG. 13 and FIG. 14. The projection 162*d* is for pressing the agitation and conveying member 182 against the cog wheel 184 during assembly of the toner cartridge 52 to fix both components.

The reason the projection 162*d* is thus provided is, because the rib 202 is provided entering into the opening 198 in the housing section 190, when assembling the toner cartridge 52 the rib 202 abuts the second edge of the opening 198 and would otherwise prevent the agitation and conveying member 182 being pressed against the cog wheel 184.

As explained above, configuration is made such that the resilient tab 206 is resiliently deformed, the cartridge shutter 162 is inserted, together with the rib 202, into the housing section 190, the resilient tab 206 then reverts to its original shape after the rib 202 has reached the opening 198 in the housing section 190, and the rib 202 enters into the opening 198 in the housing section 190. Accordingly, the cartridge shutter 162 provided with the rib 202 is easily assembled into the housing section 190.

Since the guide rail 210 and the guide groove 212 are provided between the inner peripheral face of the housing section 190 and the outer peripheral face of the cartridge shutter 162, for guiding the cartridge shutter 162 in the axial direction while positioning the cartridge shutter 162 in the peripheral direction with respect to the housing section 190, the cartridge shutter 162 provided with the rib 202 is easily assembled into the housing section 190. Furthermore, the cartridge shutter 162 is movable in a straight line to-and-fro inside the housing section 190.

The sloping face 208 is also formed to the housing section 190 for deforming the resilient tab 206 so as to move the rib 202 to the axial center side of the housing section 190 as the rib 202 is sliding along the sloping face 208 with insertion of the cartridge shutter 162 into the housing section 190. Consequently, the resilient tab 206 is resiliently deformed, and the cartridge shutter 162, along with the rib 202, is easily inserted into the housing section 190.

The projection height H of the rib 202 is set within a range such that the rib 202 does not project out from the outer peripheral face of the housing section 190 when the rib 202 is entered into the opening 198 in the housing section 190. Consequently, the rib 202 does not interfere with components at the exterior of the housing section 190, and opening and closing operation of the cartridge shutter 162 is not impeded.

Furthermore, in the image forming apparatus 50, since the cartridge shutter 162 is moved to the position where the opening 198 is open when the toner cartridge 52 is mounted, supply of toner is readily received. When the toner cartridge 52 is detached, since movement of the cartridge shutter 162 to the position where the opening 198 is closed is permitted, toner is suppressed from spilling out from the toner cartridge 52. In particular, toner can be suppressed from spilling out from the toner cartridge in comparison to when detaching a toner cartridge lacking the rib 202 inserted into the opening 198.

Note that while detailed explanation has been given regarding particular exemplary embodiments of the present invention, the present invention is not limited by these exemplary embodiments, and it is clear to a person of skill in the art that various other exemplary embodiments are possible within the scope of the present invention. For example, in the above exemplary embodiments, the cog wheel 186 provided to the apparatus main body 50A is rotated by a motor, and this driving force is transmitted to the cog wheel 184 provided to the toner cartridge 52. However, configuration may be made in which a cog wheel provided to the toner cartridge is rotated by a motor, and this driving force is transmitted to a cog wheel provide to the image forming apparatus main body.

Furthermore, in the above exemplary embodiments bias force of the coil spring 192 biasing the cartridge shutter 162 is stronger than bias force of the coil spring 152 biasing the developing section shutter 150. Accordingly, when mounting the toner cartridge 52, the developing section shutter 150 is operated first, and the opening 140 and the opening 166 are overlapped first, however there is no particular limitation thereto. For example, configuration may be made with the bias force of the coil spring 192 and the coil spring 152 determined such that the opening 140, the opening 166, the opening 198, and the opening 196 overlap with each other at substantially the same time.

Explanation has been given in the above exemplary embodiments of a case in which toner is employed as a power, however a powder other than toner may be employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder holding container comprising:

a tube with a hole formed in a wall of the tube;

a shutter that moves inside the tube to close the hole;

a projection portion that projects out from the shutter and enters the hole; and a resilient tab surrounded by a cutout provided in the shutter, and is resiliently deformable in directions in which the projection portion enters or exits the hole.

2. The powder holding container of claim 1, wherein the shutter is configured with a tubular shape, and the powder holding container further comprises a guiding section between an inner periphery of the tube and an outer periphery of the shutter for positioning of the shutter in a peripheral direction with respect to the tube while guiding along an axial direction.

3. The powder holding container of claim 1, wherein the tube is formed with a sloping face that makes contact with the projection portion as the shutter is being pushed into the tube, thereby deforming the resilient tab so that the projection portion is moved towards an axial center side of the tube.

4. The powder holding container of claim 1, wherein a projection height of the projection portion is set within a range such that the projection portion does not project out from an outer peripheral face of the tube when the projection portion has entered the hole.

5. An image forming apparatus comprising, an image forming section for forming an image on a recording medium, the powder holding container of claim 1, in which the shutter is moved to a position where the hole is open and the powder is supplied through the hole when the powder holding container is mounted to the image forming apparatus; and the shutter is moved to a position closing off the hole when the powder holding container is detached from the image forming apparatus.

6. The powder holding container of claim 1, wherein the cutout comprises a first slit in the tube disposed on one side of the resilient tab and a second slit in the tube disposed on another side of the resilient tab.

7. The powder holding container of claim 1, wherein the projection portion extends from the resilient tab.

8. The powder holding container of claim 1, wherein the shutter moves in a straight line.

9. The powder holding container of claim 1, wherein a powder is a toner suitable for developing a latent image on a charged image holding body.

* * * * *